United States Patent [19]

Niederer

[11] 3,949,570

[45] Apr. 13, 1976

[54] METHOD AND MEANS FOR FORMING KNIT FABRIC INCORPORATING A WEFT STITCH WEAVE

[75] Inventor: Kurt W. Niederer, Charlotte, N.C.

[73] Assignee: W. Schlafhorst & Co., Monchengladbach, Germany

[22] Filed: Jan. 6, 1975

[21] Appl. No.: 538,970

Related U.S. Application Data

[62] Division of Ser. No. 423,487, Dec. 10, 1973, Pat. No. 3,884,053.

[52] U.S. Cl. ..... 66/10; 66/190

[51] Int. Cl.[2] ..... D04B 9/16

[58] Field of Search ..... 66/14, 8, 7, 13, 14, 10, 66/34, 190

[56] References Cited

UNITED STATES PATENTS

| | | | |
|---|---|---|---|
| 219,619 | 9/1879 | Chase | 66/190 |
| 222,327 | 12/1879 | Stowe | 66/190 |
| 430,300 | 6/1890 | Rhome et al. | 66/10 |
| 455,464 | 9/1891 | Salisbury | 66/7 |
| 567,308 | 9/1896 | Esty | 66/190 |
| 627,945 | 6/1899 | Waterfield | 66/190 |
| 630,783 | 8/1899 | Stevens | 66/190 |
| 732,434 | 6/1903 | Nicholls | 66/10 |
| 1,932,151 | 10/1933 | Welffens | 66/10 |
| 2,009,379 | 7/1935 | Bedell | 66/9 |
| 2,017,444 | 10/1935 | Page | 66/190 |
| 2,118,108 | 5/1938 | Riley | 66/190 |
| 3,507,130 | 4/1970 | Marks et al. | 66/125 X |
| 3,621,677 | 11/1971 | Marks et al. | 66/9 |

FOREIGN PATENTS OR APPLICATIONS

| | | | |
|---|---|---|---|
| 877,060 | 9/1961 | United Kingdom | 66/14 |
| 239,261 | 8/1925 | United Kingdom | 66/9 |
| 477,703 | 6/1929 | Germany | 66/10 |
| 113,281 | 9/1900 | Germany | 66/10 |

*Primary Examiner*—Ronald Feldbaum
*Attorney, Agent, or Firm*—Richards, Shefte & Pinckney

[57] ABSTRACT

A knit fabric is provided in which a woven structure is simulated by feeding spaced warp ends while laying filling ends at opposite sides of the warp ends and causing weft stitch courses to be knit so that needle loops thereof form wales running in the space between the warp ends and passing outside of filling ends at both sides of the warp ends while intervening sinker loop portions pass to one side of the warp ends. Such fabric can be formed on any type of weft knitting means that has been adapted properly.

4 Claims, 34 Drawing Figures

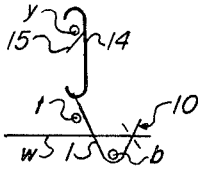
Fig. 1a
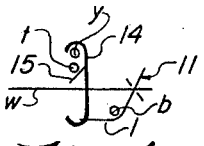
Fig. 1a
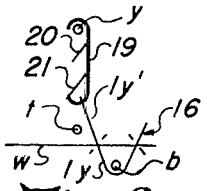
Fig. 2a
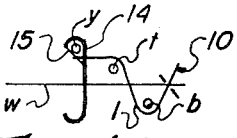
Fig. 1b
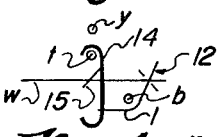
Fig. 1a''
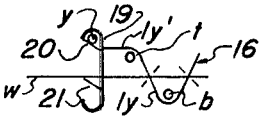
Fig. 2b
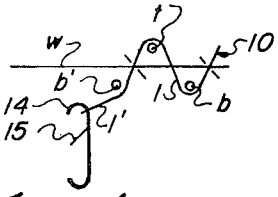
Fig. 1c
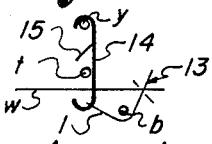
Fig. 1a'''
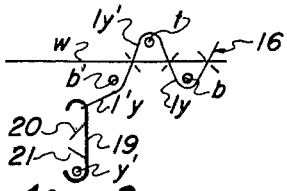
Fig. 2c
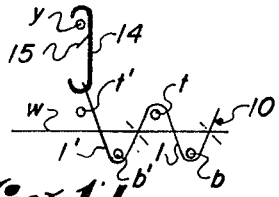
Fig. 1d
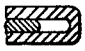
Fig. 3d
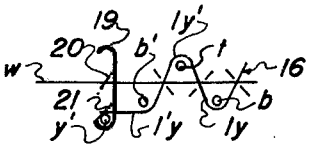
Fig. 2d
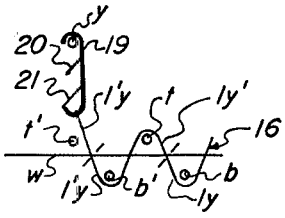
Fig. 2e
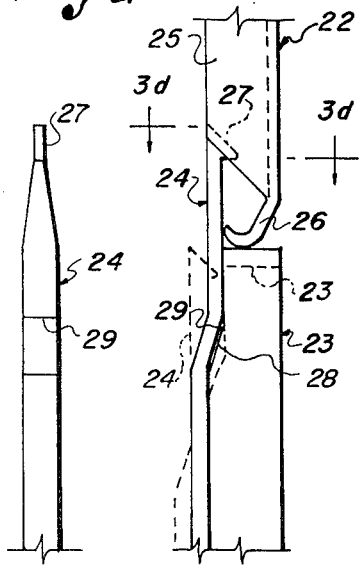
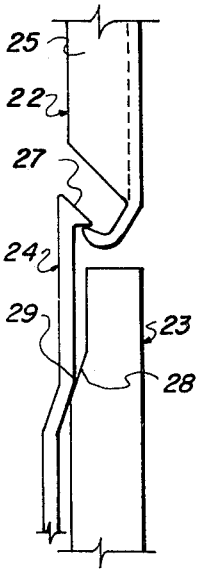
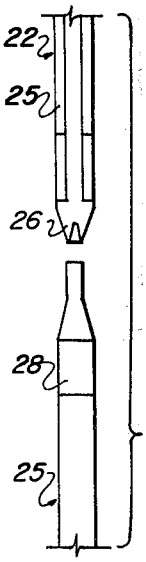
Fig. 3e
Fig. 3c Fig. 3a Fig. 3b

METHOD AND MEANS FOR FORMING KNIT FABRIC INCORPORATING A WEFT STITCH WEAVE

CROSS-REFERENCES TO RELATED APPLICATIONS

This is a division of parent application Ser. No. 423,487, filed Dec. 10, 1973, which contains claims to the knit fabric disclosed, and which has now been issued as U.S. Pat. No. 3,884,053, on May 20, 1975.

BACKGROUND OF THE INVENTION

A number of proposals have been advanced over the years for forming weft-knitted fabric so that it approaches a woven construction. Examples are U.S. Pat. Nos. 1,923,151, 732,434, and 130,866, and British Pat. No. 239,261. Such prior art proposals have commonly combined at least one knitted end with warp and weft or filling ends to produce a woven structure simulation, but in every case, insofar as I am aware, these prior proposals have either employed weft at only one side of the warp or have caused warp or weft ends to be knitted-in or captured within the loop structure of the knitted ends. As a result, the previously proposed knit fabrics of this sort have been less like woven fabrics than is desirable or their formation has involved undue complication of the knitting means provided to produce them.

According to the present invention weft or filling is laid-in at both sides of warp while causing a weft stitch pattern to integrate the warp and weft without requiring either weft inlay to be knit-in, so that only the knitting end needs to be manipulated in order to form a simulated weave and the formation proceeds in a particularly simple and advantageous manner.

SUMMARY OF THE INVENTION

In forming knit fabric according to the present invention, spaced warp ends are fed to weft knitting means in regular fashion while laying filling ends at opposite sides of the warp and causing the needle loops of weft knit courses to form wales at the spaces between the warp ends and to execute a shedding motion with respect to the warp in the course of such wale formation so that filling ends are received between the needl loops and the warp at both faces of the resulting fabric, to provide a construction simulating a woven one quite closely. The fabric thus produced is much more stable and stronger than ordinary knit fabric, and because either a jersey or links-links stitch pattern is used in forming the weft knit courses all of the variations to which such stitches are subject can be employed to obtain special effects. In addition, both or either of the warp and filling can be arranged or manipulated specially to provide further patterning possibilities.

The nature of the knit fabric of this invention, as well as the manner of forming it and representative means for doing so, are described in greater detail below in connection with the accompanying drawings.

DESCRIPTION OF THE DRAWINGS

FIGS. 1*a* through 1*d* are sequential diagrams of the stitch forming cycle for the basic FIG. 1 fabric when a double-hooked needle having a latch at only one end is employed;

FIGS. 1*a'*, 1*a''* and 1*a'''* are similar diagrams comparable to FIG. 1*a* indicating the needle phase adjustments required to produce the pattern variations illustrated in FIG. 1;

FIGS. 2*a* through 2*e* are sequential diagrams of the stitch forming cycle for the FIG. 2 fabric when a double-hooked needle having latches at both ends is used;

FIG. 3*a* details a special double-hooked needle arrangement that allows the latching at either end to be disabled whenever it is desired to draw stitches at only one fabric face as shown in FIG. 3;

FIG. 3*b* is a further detail corresponding to FIG. 3*a* but showing the needle arrangement adjusted to a pull position;

FIG. 3*c* is a plan view of the right-hand face of the latching element shown in FIG. 3*a;*

FIG. 3*d* is a sectional detail taken substantially at the line 3*d*—3*d* in FIG. 3*a;*

FIG. 3*e* is a plan view of the left-hand faces of the needle and the jack element shown in FIG. 3*b;*

FIGS. 6*a'* through 6*e'* are corresponding diagrams of the stitch forming cycle when the FIG. 6 transfer finger alternative is employed to form the FIG. 2 fabric.

DETAILED DESCRIPTION OF THE INVENTION

Figure 1:
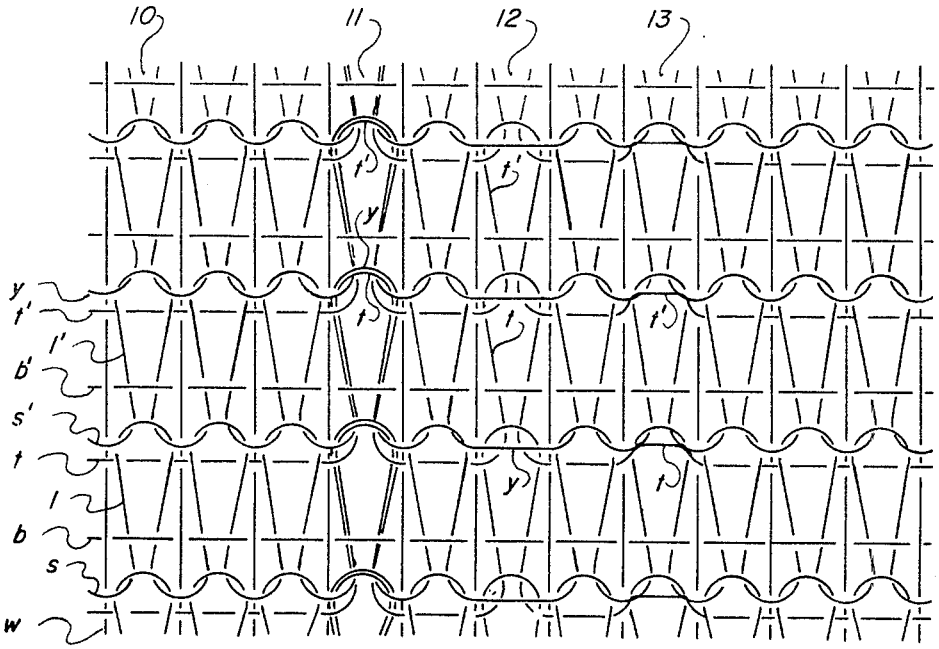
FIG. 1 is a diagram of a portion of knit fabric formed according to the present invention, in which several representative pattern variations are indicated.

The FIG. 1 diagram shows the illustrated knit fabric to be formed according to the present invention with an inlay of spaced warp ends *w* having top and bottom filling ends inlaid successively at opposite sides thereof (as at *t*—*t'* and *b*—*b'*) and having knitting yarn *y* knit in successive weft stitch courses so that needle loops *l*–*l'* thereof extend in wales running in the spaces between the warp ends and passing sinuously outside of filling ends at both sides of the warp ends, and so that connecting sinker loop portions *p* normally pass to one side of the warp ends, without any necessary knitting-in of any of the warp or filling ends.

The basic or normal knitted pattern formed in this manner is plain jersey as represented at the wale 10 in FIG. 1, although the range of patterning possibilities is suggested at the wale 11 where the successive top filling inlays *t*–*t'* are knit-in along with the knitting yarn *y*, and at the wale 12 where the successive top filling inlays *t*–*t'* are knit-in while the knitting yarn *y* is floated, and at the wale 13 where the successive top filling inlays *t–t'* are tucked at each successive needle loop *l–l'*.

FIGS. 1*a* through 1*d* diagram the formation of the basic FIG. 1 knit fabric (as at wale 10) with double-hooked needles 14 having a latch 15 at only one end (i.e., at its upper end as diagrammed). In FIG. 1*a*, the needle 14 is indicated at a raised position with the latch 15 open to receive the knitting yarn *y* within its upper hook, while holding a loop *l* drawn at the last course so as to have been passed under the bottom filling inlay *b* to capture it against the warp inlay *w* and then extended upwardly to form a shed above the warp inlay *w* to receive the succeeding top filling inlay *t* thereat. The following FIG. 1*b* indicates a lowering of the needle 14 so that the loop *l* has closed the latch 15 in preparation for casting off after having captured the knitting yarn *y* and after having been passed over the previously received top filling inlay *t* in preparation for capturing it against the warp inlay *w*. Upon full descent of needle 14, as indicated in FIG. 1*c*, the loop *l* is cast off while fully capturing top filling inlay *t* in the process, and a succeeding loop *l'* is held at an extended position below the warp inlay *w* to form a shed thereat for the suceeding bottom filling inlay *b'*. Subsequent raising of needle 14 as indicated in FIG. 1*d* completes the cycle for a succeeding course feed of knitting *y* to repeat the foregoing fabric formation steps, the extent of the loops drawn in the fabric formed being indicated in FIGS. 1*a* through 1*d* by dashes at each side of the wale and warp inlay crossing points.

Whenever it is desired to knit-in the top filling inlay *t–t'* along with the knitting yarn *y* as at wale 11, the phase of needle 14 is adjusted as indicated in FIG. 1*a'* so that both the knitting yarn *y* and a top filling yarn *t* are captured above the latch 15 at each course. If only the top filling inlay is to be knit-in as at wale 12, the needle adjustment is such as to miss the knitting yarn *y* and thereby cause it to float while capturing the top filling inlay *t* as indicated in FIG. 1*a''*. Alternatively, a needle phase adjustment, as indicated in FIG. 1*a'''*, such as to receive the knitting yarn *y* above and the top filling inlay *t* below latch 15 at the front of the needle will result in tucking the top filling inlay as at wale 13. Such needle phase adjustments do not exhaust the patterning possibilities by any means, as will be noted further presently, but are representative of the flexibility available in this respect.

Figure 2:
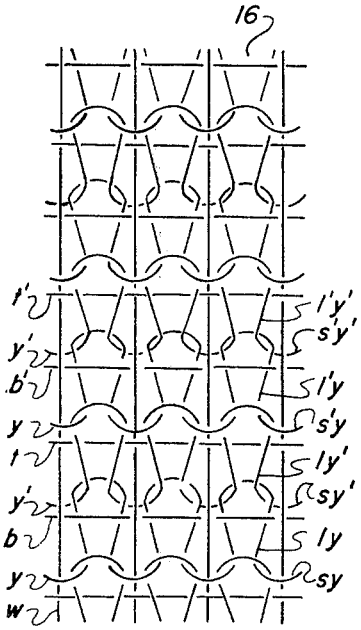
FIG. 2 is a further diagram of knit fabric formed in accordance with the present invention so that stitches are drawn alternately at opposite faces of the fabric.

FIG. 2 diagrams a modified knit fabric construction embodying the present invention in which top and bottom knitting yarns *y* and *y'* are employed to form a links-links stitch pattern and in which a course is completed in relation to every filling inlay, rather than every other filling inlay as in FIG. 1. Otherwise, the FIG. 2 construction is comparable in that it incorporates an inlay of spaced warp ends *w* with top and bottom filling ends *t–t'* and *b–b'* inlaid successively at opposite sides thereof. The FIG. 2 links-links stitch pattern, however, results in forming wales 16 at the spaces between the warp inlay *w* in which successive needle loops, such as *ly* and *ly'* are drawn at opposite sides or faces of the knit fabric, and the respective connecting sinker loop portions *sy* and *sy'* pass alternately at opposite sides of the warp inlay *w*, such side in any instance (note *s'y* and *s'y'* also) being the same one at which any immediately preceding filling end *t* or *b* is laid, as is true in FIG. 1 as well.

Figure 3:
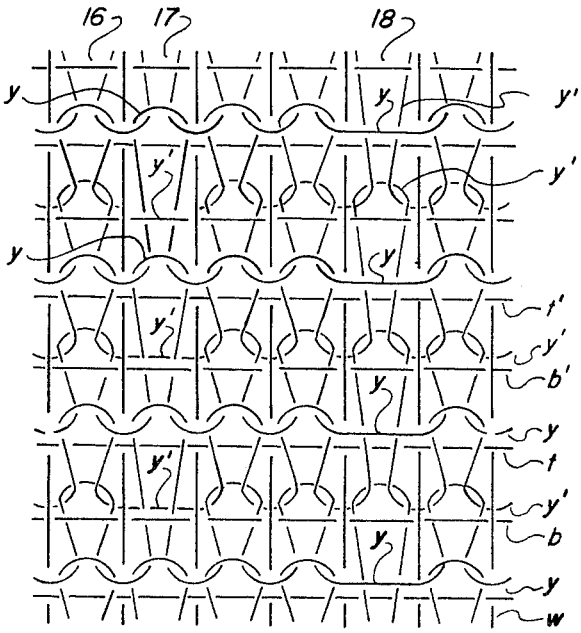
FIG. 3 is an additional knit fabric diagram according to the present invention in which a fabric construction corresponding to FIG. 2 has stitches drawn at only one fabric face in certain wales.

In FIG. 3 the same basic fabric construction is diagrammed with pattern variations at wales 17 and 18 in which, respectively, the knitting yarns *y* and *y'* are drawn in welt stitch fashion, while the other knitting yarns *y'* and *y* at these wales are floated, to produce the resulting pattern effect alternately in relation to opposite faces of the fabric, although it will be recognized that this pattern effect could be produced solely in relation to one face of the fabric if desired.

The FIG. 2 knit fabric construction can be formed, as diagrammed in FIGS. 2*a* through 2*e*, with needles 19 that are both double-hooked and double-latched (as at 20 and 21). FIG. 2*a* indicates a needle 19 at a cycle-starting raised position for receiving the top knitting yarn *y* at its upper hook portion above latch 20 while holding the last-formed loop *ly'* extended from its lower hook portion so as to form a shed in relation to the warp inlay *w* at which the top filling inlay *t* is received. FIGS. 2*b* and 2*c* indicate the progressive descent of needle 19 to cause capturing of the top filling inlay *t* against the warp inlay *w* by the loop *ly'* as it is cast off and succeeding *l'y* is formed and held extended below warp inlay *w* to receive the next bottom filling inlay *b'* while the bottom knitting yarn *y'* is inserted in the lower hook portion of needle 19 below latch 21. Thereupon, the progressive return of needle 19 to its cycle-starting position, as indicated in FIGS. 2*d* and 2*e*, results in capturing the bottom filling inlay *b'* below warp inlay *w* as the loop *l'y* is cast off, and in forming the next loop *l'y'* and holding it extended above warp inlay *w* for reception of the succeeding filling inlay *t'* above warp inlay *w* while the top knitting yarn *y* is again inserted for repeating the cycle.

For the pattern variations illustrated in FIG. 3 at wales 17 and 18 it is necessary that the needle arrangement employed be capable of executing a knitting cycle corresponding to the one just described while providing for selective adjustment to hold a loop formed in one of the knitting yarns *y* or *y'* against casting off so that it is elongated in welt stitch fashion with concurrent floating of the other knitting yarn. Such a needle arrangement is illustrated in FIGS. 3*a* through 3*e* in which a double-hooked needle 22 (only one end of which is shown) that carries no latches is combined with compound actuating jacks (only one of which is shown) each incorporating a cam component 23 and a latch component 24, both of which components carry butts (not shown) for operation in the usual manner from knitting cams to provide for the above-mentioned selective adjustment by reason of the illustrated relation of the components in combination with needle 22.

In particular, the main body portion 25 of needle 22 has a channel formation in cross-section (as seen in FIG. 3*d*) from the base of which hook portions 26 extend at each end (compare FIGS. 3*a*, 3*b* and 3*e*). The channel formation of the needle main body portion 25 is such as to allow nesting extension therein of the adjacent end of latch component 24 at which an inwardly projecting lug portion 27 is formed (see FIGS. 3*a* and 3*d*). Such nested positioning of latch component 24 serves, as shown in FIG. 3*a*, to close or latch the adjacent needle hook portion 26 so as either to block insertion of a knitting yarn thereat or to provide for casting off a loop previously formed and held at the other needle end. Thus, if it is assumed that the needle 22 has been lowered to the full line position shown in FIG. 3*a* and holds a loop extended from its upper hook portion 26 (i.e., the one not shown in FIG. 3*a*), the nested latch portion 24 will prevent insertion of the other knitting yarn presented at this lowered position and cause it to float during subsequent raising of needle 22, while if the jack components 23 and 14 at the upper hook portion are shifted to the relative portions shown in FIG. 3*b* to effect the needle raising and the same thing is done at the lower hook portion as soon as knitting yarn insertion at the lowered position has been blocked, the result will be to transfer the extended loop from the upper to the lower hook portion as the needle is raised and form an elongated welt stitch of the sort illustrated at wales 17 and 18 in FIG. 3. It will be apparent that the difference between the stitch formations at these wales 17 and 18 is simply a matter of which knitting yarn *y* or *y'* is held and which is floated, and that either stitch formation can be produced in the foregoing manner as a matter of choice whenever desired.

For casting off, the jack components 23 and 24 at the lower hook portion 26 are shifted to the FIG. 3*b* position to effect needle lowering, while the jack components at the upper hook portion are shifted to the full-line FIG. 3*a* position as soon as a knitting yarn insertion has been effected for forming the next welt stitch. Under these conditions, the lowering of needle 22 will cause the elongated welt stitch loop held at the lower hook portion to shift therefrom upwardly along the main body portion 25 of needle 22 and eventually to transfer to the back of the nested latch component 24 from which it can be cast off by shifting the jack components 23 and 24 to the FIG. 3*a* dotted line positions in relation to the upper needle hook portion as the needle descent is completed. For the basic stitch formation shown at wales 16 in FIGS. 2 and 3, the needle and jack manipulation corresponds exactly except that there is no blocking of knitting yarn insertion and loops are cast off twice, rather than only once, during every cycle.

Relative shifting of the jack components 23 and 24 in relation to the needle hook portions to the several positions noted above is accomplished, in combination with butt actuation of these components, by interaction of an inclined cam portion 28 of cam component 23 with a nose portion 29 of latch component 24 arranged to ride thereat under any suitably arranged bias. The full-line FIG. 4*a* positioning of jack components 23 and 24 is obtained when the latch component nose portion 29 is advanced beyond the cam component incline 28 toward the extending end of cam component 23 and with this extending end abutting, or substantially so, at the adjacent needle hook portion 26, while the FIG. 3*a* dotted-line position results from a withdrawal of latch component 24 so that its nose portion 29 rides past cam component incline 28 in the opposite direction prior to withdrawal of cam component 23 to the dotted-line position indicated. If withdrawal of cam component 23 to such a position, as in FIG. 3*b*, takes place first the result is to engage the latch component lug portion 27 with the adjacent needle hook portion 26 as latch component 24 is then withdrawn because the lug portion 27 of the latter will not clear hook portion 26 and the latch component nose portion 29 will be allowed to ride only to an intermediate position on cam component incline 28 under these conditions as seen in FIG. 3*b*.

Engagement of a latch component lug portion 27 with the adjacent needle hook portion 26 provides for pulling the needle 22 through an ascent or descent depending on which end of the needle is engaged, and it also results in opening the engaged hook portion for knitting yarn insertion upon completion of the ascent or descent, as indicated earlier. It should be noted additionally that such engagement makes tuck knitting possible; that is, if FIG. 3*b* is viewed as showing the relation of needle 22 and jack components 23 and 24 both at the beginning of and entirely through a needle ascent effected by pull of similarly engaged jack components at the other needle end, then the hook portion 26 shown would receive a knitting yarn as the ascent was commenced and the opposite end hook portion would hold a previously formed loop extended therefrom. As the ascent proceeded a new loop would be formed in the yarn inserted in the hook portion 26 shown, but this new loop would develop as a tuck loop because the jack adjustment shown would cause the previously formed loop to transfer from the opposite end hook portion to the lower one shown and a tuck stitch formation would result to provide a further patterning possibility.

To indicate more fully the wide range of pattern variations available in knit fabrics embodying the present invention, before taking into account such general patterning factors as the relative type, size or color of the yarn components employed, the following possibilities are outlined as a basis for the series of possibility combination tabulations that follow next.

1. The Knitting Yarn or Yarns* can be 1.1 Knit in regular fashion.
1.2 Missed, while retaining an old loop and/or knitting-in a filling yarn.
1.3 Omitted selectively, while retaining and old loop and/or knitting-in a filling yarn.

*In the tabulations that follow a suffixed "*a*" is used, where needed, to indicate that a top Needles yarn is involved, and a suffixed "*b*" for a bottom knitting yarn.

2. The Filling Inlay* can be 2.1 Inlaid behind needle in regular fashion.
2.2 Inserted in hook at needle front so as to be knit-in.
2.3 Positioned at front of needle below latch so as to be tucked.
2.4 Omitted selectively.

*In the tabulations that follow a suffixed "*a*" is used, where needed, to indicate that a top filling inlay is involved, and a suffixed "*b*" for a bottom filling inlay.

3. The Needles can be 3.1 Cycled for knitting in regular fashion at top.
3.2 Cycled for knitting in regular fashion at bottom.
3.3 Prevented from casting off at top position, while insertion of new yarn is blocked.
3.4 Same at bottom position.
3.5 Prevented from casting off at top position, while allowing insertion of new yarn.
3.6 Same at bottom.
3.7 Prevented from raising enough to knit.
3.8 Prevented from lowering enough to knit.

4. The Warp Inlay can be 4.1 Inlaid between needles in regular fashion.
4.2 Omitted selectively.

In the tabulations that follow, the last-noted warp inlay variations are ignored because they have no direct effect on knitting action. The first tabulation indicates and assigns combination numbers to the various combinatons of needle action possible, and then a tabulation follows in order for each possible needle action combination to indicate the pattern variations possible with varying conditions of knitting yarn and filling inlay manipulation, beginning at the next page. In aggregate, these tabulations show that over 900 pattern variations are possible through selective combination of the indicated conditions of needle action and manipulation of knitting yarn and filling inlay.

TABLE III

Needle Action Combination 3.1.4 — Regular knitting at top fabric face and welt stitching at bottom — 72 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.2.a | 2.1.a | | | | | | | | | | | | |
| | 2.2.a | X | X | X | X | X | X | X | X | X | X | X | X |
| | 2.3.a | | | | | | | | | | | | |
| | 2.4.a | | | | | | | | | | | | |
| 1.3.a | 2.1.a | | | | | | | | | | | | |
| | 2.2.a | X | X | X | X | X | X | X | X | X | X | X | X |
| | 2.3.a | | | | | | | | | | | | |
| | 2.4.a | | | | | | | | | | | | |

TABLE IV

Needle Action Combination 3.1.6 — Regular knitting at top fabric face and tuck stitching at bottom — 72 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.2.a | 2.1.a | | | | | | | | | | | | |
| | 2.2.a | X | X | X | X | X | X | X | X | X | X | X | X |
| | 2.3.a | | | | | | | | | | | | |
| | 2.4.a | | | | | | | | | | | | |
| 1.3.a | 2.1.a | | | | | | | | | | | | |
| | 2.2.a | X | X | X | X | X | X | X | X | X | X | X | X |
| | 2.3.a | | | | | | | | | | | | |
| | 2.4.a | | | | | | | | | | | | |

TABLE I

Needle Action Combinations Possible

| | 3.1 | 3.2 | 3.3 | 3.4 | 3.5 | 3.6 | 3.7 | 3.8 |
|---|---|---|---|---|---|---|---|---|
| 3.1 | — | 3.1.2 | — | 3.1.4 | — | 3.1.6 | — | — |
| 3.2 | | — | 3.2.3 | — | 3.2.5 | — | — | — |
| 3.3 | | | — | 3.3.4 | — | 3.3.6 | — | — |
| 3.4 | | | | — | 3.4.5 | — | — | — |
| 3.5 | | | | | — | 3.5.6 | — | — |
| 3.6 | | | | | | — | — | — |
| 3.7 | | | | | | | 3.7.7 | — |
| 3.8 | | | | | | | | 3.8.8 |

TABLE II

Needle Action Combination 3.1.2 — Regular knitting at both fabric faces — 36 pattern variations are possible*.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.2.a | 2.1.a | | | | | | | | | | | | |
| | 2.2.a | X | X | X | X | X | X | X | X | X | X | X | X |
| | 2.3.a | | | | | | | | | | | | |
| | 2.4.a | | | | | | | | | | | | |
| 1.3.a | 2.1.a | | | | | | | | | | | | |
| | 2.2.a | X | X | X | X | X | X | X | X | X | X | X | X |
| | 2.3.a | | | | | | | | | | | | |

-continued

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.1.b | 2.1.b | 2.2.b | 2.3.b | 2.4.b |
| | 2.4.a | | | | | | | | | | | | |

*In this tabulation and all that follow, an "X" is used to indicate a possible pattern variation. Where no "X" is shown there would be no yarn available for knitting and, therefore, no variation possible.

TABLE V

Needle Action Combination 3.2.3 — Welt stitching at top fabric face and regular knitting at bottom — 72 pattern variations possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |
| 1.2.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |
| 1.3.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |

TABLE VI

Needle Action Combination 3.2.5 — Tuck stitching at top fabric face and regular knitting at bottom — 72 pattern variations possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |
| 1.2.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |
| 1.3.a | 2.1.a | X | X | X | X | | X | | | | X | | |
| | 2.2.a | X | X | X | X | | X | | | | X | | |
| | 2.3.a | X | X | X | X | | X | | | | X | | |
| | 2.4.a | X | X | X | X | | X | | | | X | | |

TABLE VII

Needle Action Combination 3.3.4 — Welt stitching at both fabric faces — 144 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.9 | X | X | X | X | X | X | X | X | X | X | X | X |
| 1.2.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.3.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |

TABLE VIII

Needle Action Combination 3.3.6 — Welt stitching at top fabric face and tuck stitching at bottom — 144 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.2 | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.2.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.3.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |

TABLE IX

Needle Action Combination 3.4.5 — Tuck stitching at top fabric face and welt stitching at bottom — 144 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.2.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |
| 1.3.a | 2.1.a | X | X | X | X | X | X | X | X | X | X | X | X |
| | 2.2.a | X | X | X | X | X | X | X | X | X | X | X | X |
| | 2.3.a | X | X | X | X | X | X | X | X | X | X | X | X |
| | 2.4.a | X | X | X | X | X | X | X | X | X | X | X | X |

TABLE X

Needle Action Combination 3.5.6 — Tuck stitching at both fabric faces — 144 pattern variations are possible.

TABLE XI

Needle Action Combination 3.7.7 — Needle remains in bottom position — 16 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.2.b | 2.4.b | 2.1.b | 2.2.b | 2.3.b | 2.4.b |
| 1.1.a | 2.1.a | | | | | | | | | | | | |
| | 2.2.a | | | | | | | | | | | | |
| | 2.3.a | | | | | | | | | | | | |
| | 2.4.a | | | | | | | | | | | | |
| 1.2.a | 2.1.a | | | | | X | | | X | X | | | X |
| | 2.2.a | | | | | | | | | | | | |
| | 2.3.a | | | | | | | | | | | | |
| | 2.4.a | | | | | X | | | X | X | | | X |

-continued

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.2.b | 2.4.b | 2.1.b | 2.2.b | 2.3.b | 2.4.b |
| 1.3.a | 2.1.a | | | | | X | | | X | X | | | X |
| | 2.2.a | | | | | | | | | | | | |
| | 2.3.a | | | | | | | | | | | | |
| | 2.4.a | | | | | X | | | X | X | | | X |

TABLE XII

Needle Action Combination 3.8.8 — Needle remains in top position — 16 pattern variations are possible.

| | | 1.1.b | | | | 1.2.b | | | | 1.3.b | | | |
|---|---|---|---|---|---|---|---|---|---|---|---|---|---|
| | | 2.1.b | 2.2.b | 2.3.b | 2.4.b | 2.1.b | 2.2.b | 2.3.b | 2.4.b | 2.1.b | 2.2.b | 2.3.b | 2.4.b |
| 1.1.a | 2.1.a | | | | | | | | | | | | |
| | 2.2.a | | | | | | | | | | | | |
| | 2.3.a | | | | | | | | | | | | |
| | 2.4.a | | | | | | | | | | | | |
| 1.2.a | 2.1.a | | | | | X | | | X | X | | | X |
| | 2.2.a | | | | | | | | | | | | |
| | 2.3.a | | | | | | | | | | | | |
| | 2.4.a | | | | | X | | | X | X | | | X |
| 1.3.a | 2.1.a | | | | | X | | | X | X | | | X |
| | 2.2.1 | | | | | | | | | | | | |
| | 2.3.a | | | | | | | | | | | | |
| | 2.4.a | | | | | X | | | X | X | | | X |

Figure 4:
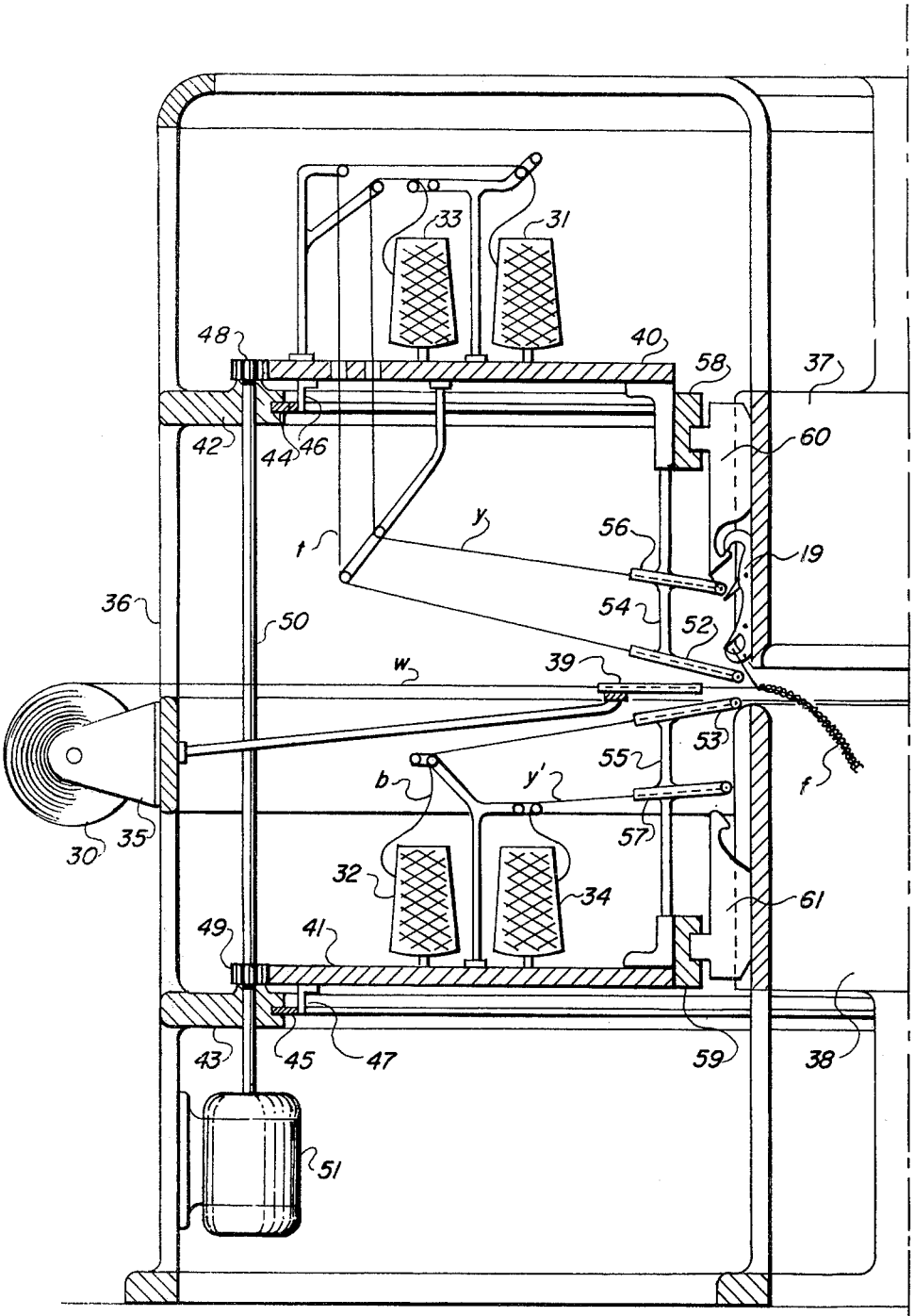
FIG. 4 is a sectional illustration indicating the general arrangement of knitting apparatus suitable for forming fabric in accordance with the present invention.

Turning to FIG. 4 of the drawings, which indicates the general arrangement of knitting apparatus suitable for forming knit fabric according to the present invention in the manner just described, the warp inlay *w* is shown being drawn from a beam supply at 30, and the top and bottom filling inlays *t* and *b* and knitting yarns *y* and *y'* from respective cone packages 31, 32, 33 and 34. The warp inlay beam supply 30 is supported in a bracket 35 mounted at the outer perimeter of a frame structure 36 of annular form that includes top and bottom needle cylinders 37 and 38 at its inner perimeter, and in order to provide a warp inlay feed to the entire circumference of needle cylinders 37 and 38 a series of beam supplies 30 is spaced about the frame structure 36 from which the individual warp inlay ends are directed through a series of feed tubes 39 circularly spaced adjacent the cylinders 37 and 38 so that the warp inlay *w* is presented with the spacing desired in the knit fabric to be produced.

The frame structure 36 including the needle cylinders 37 and 38, as well as the warp inlay supply 30 and feed tubes 39, remain stationary during operation of the knitting apparatus, while top and bottom turntables 40 and 41 are arranged within the annular form of frame structure 36 for relative feeding of the filling inlays and knitting yarns. To support the turntables 40 and 41, the frame structure 36 is formed with inwardly projecting circular flanges 42 and 43 having inner slotted edges at which bearing rings 44 and 45 are slidably received that are attached by brackets 46 and 47 to the turntables 40 and 41 so as to support them rotatably. Gear teeth are provided at the outer periphery of turntables 40 and 41 for engagement by pinions 48 and 49 carried on a drive shaft 50 extending upwardly through bearing portions arranged in flanges 42 and 43 from a motor 51 mounted adjacent the base of frame structure 36 and from which rotation of turntables 40 and 41 is actuated.

As seen in FIG. 4, the rotation of turntables 40 and 41 takes place in a clockwise direction from a top plan standpoint so as to lay the top and bottom filling ends *t* and *b* at opposite sides of the warp inlay *w* as directed by feed tubes 52 and 53 to which these ends are trained from the supply packages 31 and 32 which are carried on turntables 40 and 41, as are supporting standards 54 and 55 fo the feed tubes. The same standards 54 and 55 support additional feed tubes 56 and 57 by which the top and bottom knitting yarns *y* and *y'* are supplied to needles which are shown as being of the double-hooked and double-latched type previously designated by the reference numeral 19 (see FIGS. 2*a* through 2*e*) for producing fabric as shown in FIG. 2. As in the case of the filling inlay, the knitting yarns *y* and *y'* are trained to the feed tubes 56 and 57 from the supply packages 33 and 34 carried by turntables 40 and 41. The turntables 40 and 41 also carry knitting cams 58 and 59 at which the butts of top and bottom needle actuating jacks 60 and 61 ride to produce the knitting wave as the turntables are rotated.

No attempt is made in FIG. 4 to indicate the contour of knitting cams 58 and 59, although the nature of the knitting wave is diagrammed in FIG. 5 and will be described further presently. It will also be recognized that more complicated mechanism than illustrated would be needed to direct the alternating interaction of jacks 60 and 61 with needle 19, but as such interaction is a matter of well established and familiar prior art knowledge no attempt has been made to indicate it any further than is illustrated. Additionally, it should be noted that the illustrated type of needle 19 might be replaced as a matter of choice with one carrying only a single latch as previously designated by the reference numeral 14 (see FIGS. 1*a* through 1*d*) if it were desired to produce fabric of the FIG. 1 type, rather than FIG. 2 fabric, in which event the feeding of bottom knitting yarn *y'* would be eliminated. Likewise, a special needle and compound jacks of the sort previously designated in FIGS. 3*a* through 3*e* might alternatively be employed to allow pattern variations such as are diagrammed in FIG. 3. In any case, the fabric produced is delivered between the adjacent needle cylinder edges, as indicated at F in FIG. 4, so as to be taken-down within the bottom needle cylinder 38 by any suitable collecting means (not shown).

Figure 5:
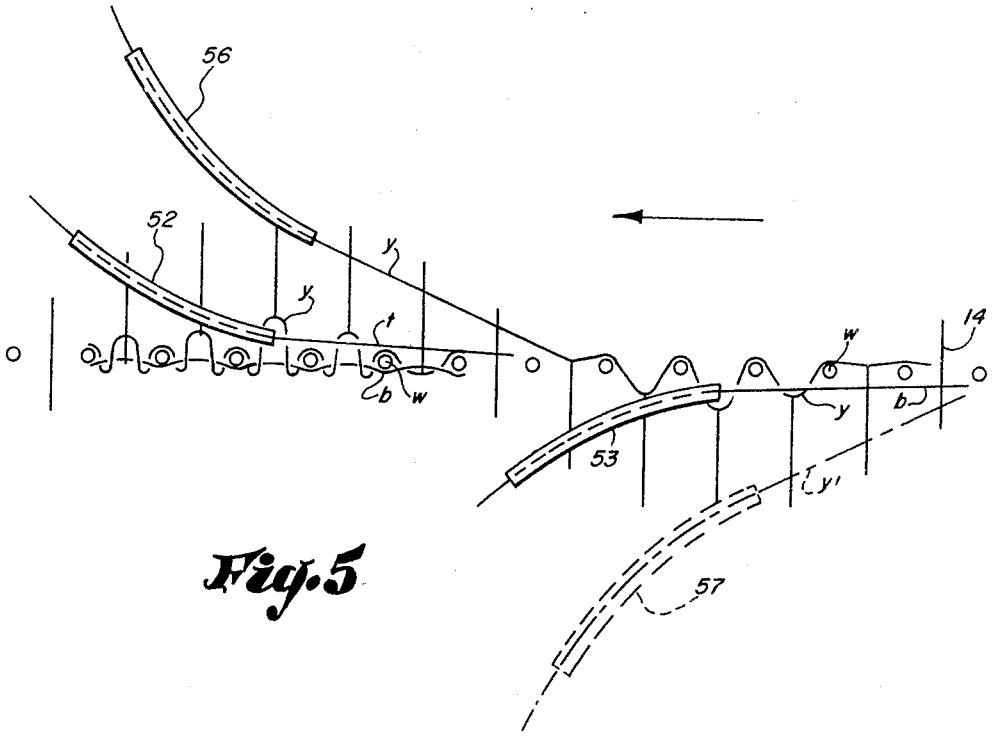
FIG. 5 is a schematic illustration of the basic knitting wave during operation of the FIG. 4 apparatus.

The knitting wave diagrammed in FIG. 5 is for a fabric of the FIG. 1 type. The inlay of spaced warp ends *w* is represented as feeding perpendicular to the sheet between needles 14 which are caused to pass through a knitting wave of the sort indicated in repeating fashion about the FIG. 4 needle cylinders 60 and 61. Toward the right in FIG. 5 a top knitting yarn *y*, having previously been inserted from feed tube 56 traveling relatively in the arrow-indicated direction, is shown having loops formed downwardly therein as needles 14 are lowered between the spaced warp ends *w*, while a bottom filling end *b* is laid in front of these loops from a similarly traveling feed tube 53. Then, toward the left in FIG. 5, the same loops are shown (in discontinuous relation) as they are brought under the inlaid bottom filling end *b* and then extended upwardly between warp ends *w* as a top filling end *t* is laid in front of them from feed tube 52. These loops will then be brought over the top filling inlay *t* and cast off as the needles 14 descend to commence formation of a succeeding course of loops. While only one feed of knitting yarn *y* and filling inlay *b* and *t* is indicated in FIG. 5, it will be recognized that the FIG. 4 turntables 40 and 41 can be equipped to supply as many feeds as are desired and space will allow. Finally, it should be noted that if a bottom filling yarn *y'* were also to be employed in forming the fabric being produced, it would be supplied from a feed tube 57 as indicated in broken lines at the bottom right in FIG. 5.

Figure 6:
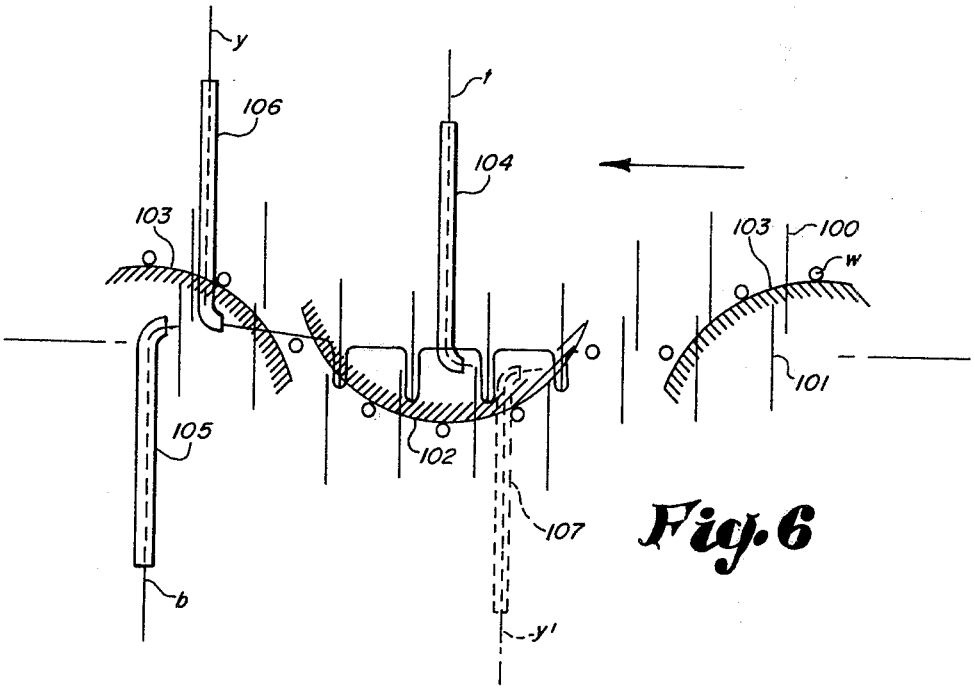
FIG. 6 is a further schematic knitting wave illustration for an alternative form of apparatus in which the needle means takes the form of transfer fingers.

The basic fabric constructions of FIGS. 1 and 2 can also be formed by knitting apparatus in which the needle means take the form of paired top and bottom transfer fingers 100 and 101, as indicated first in the further knitting wave diagram forming FIG. 6, in which it will be seen that the warp inlay *w* fed between the pairs of transfer fingers 100 and 101 downwardly and upwardly displaced by camming plates 102 and 103 for inlaying top and bottom filling ends *t* and *b* from feed tubes 104 and 105 as the transfer fingers 100 and 101 are manipulated to handle a top knitting yarn *y* supplied from a feed tube 106. If a bottom knitting yarn *y'* is also employed in the construction it is supplied from an additional feed tube as indicated at 107 in FIG. 6.

Figure 6A:
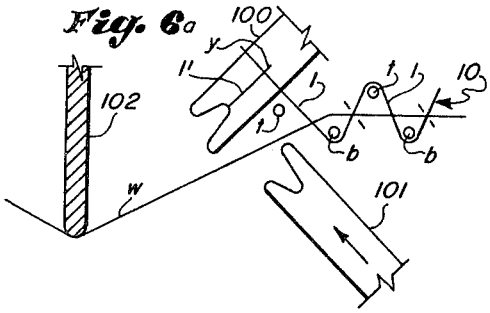
FIGS. 6*a* through 6*e* are sequential diagrams of the stitch forming cycle when the FIG. 6 transfer finger alternative is employed to form the basic FIG. 1 fabric.
Figure 6A:
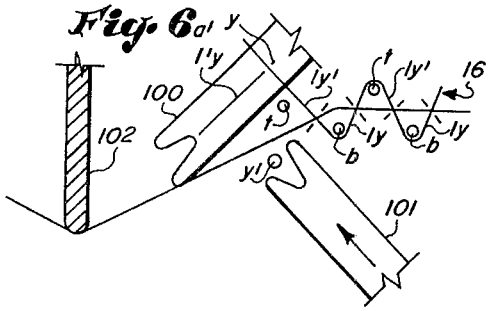

The manner in which transfer fingers 100 and 101 are manipulated to knit the fabric is indicated more fully in FIGS. 6*a* through 6*e* which diagram the sequential steps of a stitch forming cycle for the basic fabric structure of FIG. 1. In FIG. 6*a* the top transfer finger 100 is shown holding a previously formed knitting yarn loop *l* on its main body after having formed a succeeding loop *l'* extending from the illustrated crotch at its transfer end within the old loop *l* and having positioned the newly formed succeeding loop *l'* in the advancing path of the perpendicularly related bottom transfer finger 101. The previously formed loop *l* being held extends from transfer finger 100 above an inlaid top filling end *t* to previously formed fabric in which other old loops *l* pass above and below previously inlaid top and bottom filling ends *t* and *b* arranged at opposite sides of the warp inlay *w* which extends in turn to the previously formed fabric below the last inlaid top filling end *t* by reason of downward displacement by cam plate 102.

Figure 6B:
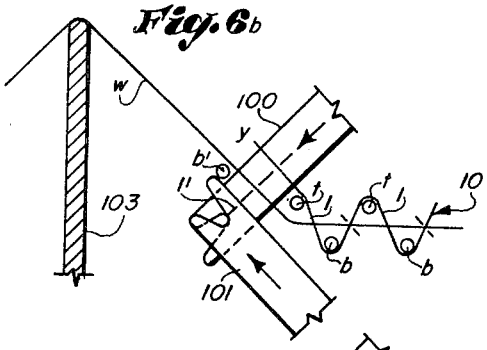
Figure 6B:
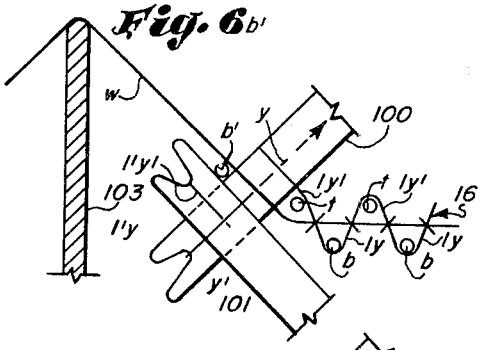
Figure 6C:
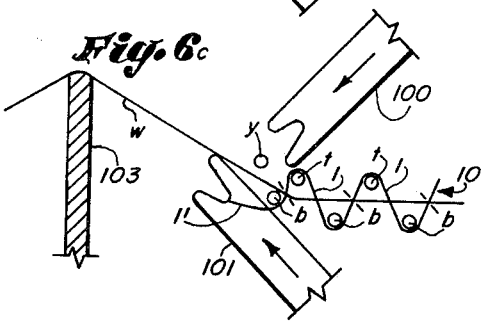
Figure 6C:
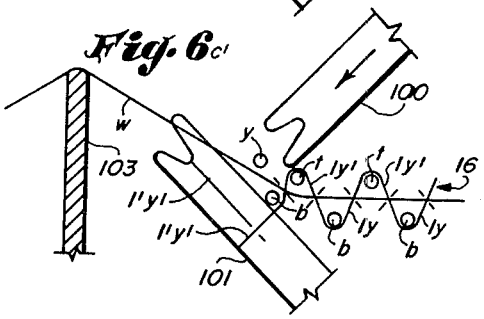
Figure 6D:
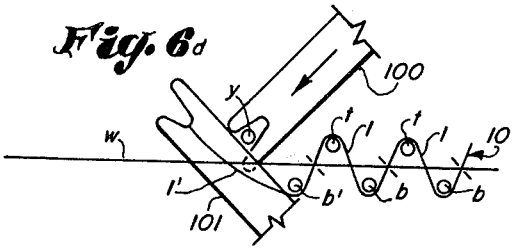
Figure 6D:
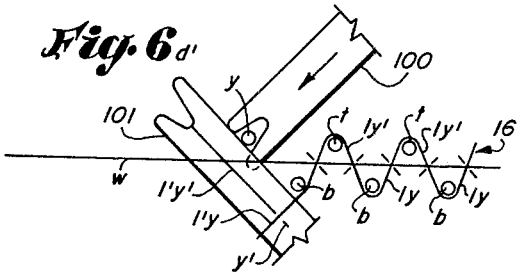
Figure 6E:
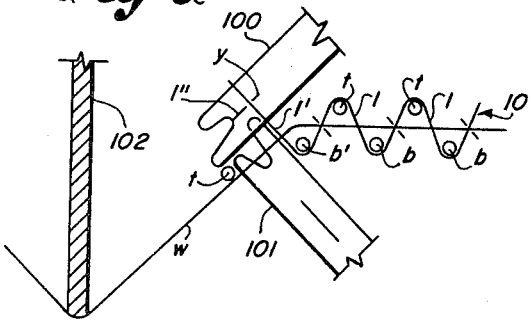
Figure 6E:
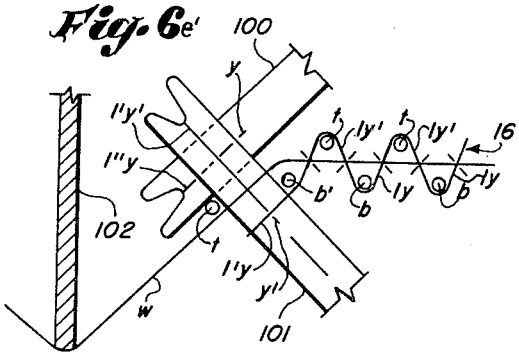

FIG. 6*b* shows the bottom transfer finger 101 having advanced to take the newly formed loop *l'* from top transfer finger 100 as the latter commences to withdraw and as the warp inlay *w* has been displaced upwardly by cam plate 103 to allow inlaying of the next bottom filling end *b'*. The withdrawal of top transfer finger 100 results, as diagrammed by FIG. 6*c*, in casting off the old loop *l* previously held thereon and in transferring the newly formed loop *l'* to bottom transfer finger 101 so that the loop chain is carried over the last inlaid top filling end *t* and below the last inlaid bottom one *b'* as the bottom transfer finger continues to advance and as the knitting yarn *y* is inserted in the now advancing path of the withdrawn top transfer finger 100. The bottom transfer finger 101 continues to advance until it has positioned the transferred loop *l'* to be taken onto the main body of the advancing top transfer finger 100 which closes on the inserted knitting yarn *y* as it advances as seen in FIG. 6*d*. As the top transfer finger 100 takes the loop *l'* onto its main body it forms the inserted knitting yarn *y* into a succeeding loop *l''* extending therethrough, as indicated in FIG. 6*e*, while the warp inlay *w* is again displaced downwardly by cam plate 102 to allow inlaying of the next top filling end *t'* and the bottom transfer finger 101 withdraws for positioning to commence a repeating cycle at the FIG. 6*a* condition.

For forming a fabric structure of the FIG. 2 sort, the transfer finger manipulation differs to the extent necessary for handling top and bottom knitting yarns *y* and *y'* and for allowing both transfer fingers 100 and 101 to form new loops alternately in these yarns and alternately transfer these loops to the main body of the other, as diagrammed in FIGS. 6*a'* through 6*e'*. Thus, if FIG. 6*a* is compared with FIG. 6*a'*, it will be seen that the latter differs in that the advance of top transfer finger 100 is enough greater to position the newly formed loop *l'y* thereon to be taken onto the main body of bottom transfer finger 101, and in that a bottom knitting yarn *y'* has been inserted in the advancing path of finger 101, while in the previously formed fabric two loops *ly* and *ly'* are formed in every cycle rather than just a single loop *l*. And with these differences persisting, the continuing sequential steps diagrammed in FIGS. 6*b'* through 6*e'* are similarly comparable with the corresponding FIG. 6*b* through 6*e* diagrams to indicate the analogous formation of FIG. 2 fabric.

Figure 7:
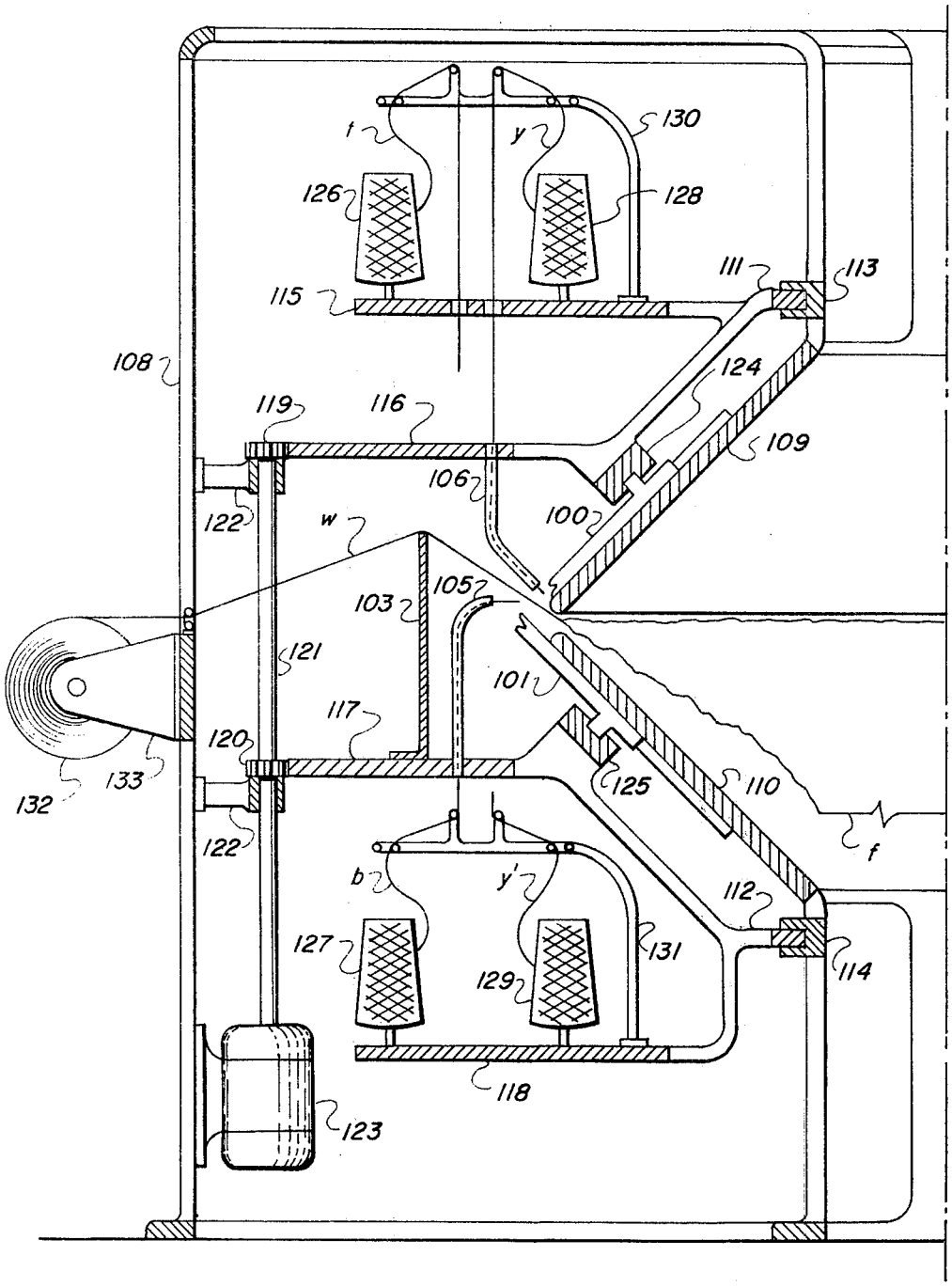
FIG. 7 is a sectional illustration indicating the general arrangement of knitting apparatus employing the transfer finger alternative for forming fabric in accordance with the present invention.

Finally, FIG. 7 illustrates the general arrangement of knitting apparatus suitable for applying the transfer finger alternative to form knit fabric incorporating the basic construction of FIG. 1 or 2. As in the case of the FIG. 4 apparatus embodiment, the FIG. 7 embodiment is provided with a frame structure 108 of annular form that has top and bottom needle (or transfer finger) cylinders 109 and 110 arranged at its inner perimeter. In this case, the cylinders 109 and 110 are angled at 45° toward the outer perimeter so that the respective transfer fingers 100 and 101 carried thereby are perpendicularly related. Also, turntables 111 and 112 are carried within the annular form of frame structure 108 at slotted circular flanges 113 and 114 located this time above and below the cylinders 109 and 110 at the inner perimeter. Each of the turntables 111 and 112 provided for this embodiment have a two-level structure forming upper and lower platform portions 115–116 and 117–118 in each case. The lower platform portion 116 of top turntable 111 and the upper platform portion 117 of bottom turntable 112 are both provided with gear teeth at their outer edges and are engaged thereat by pinions 119 and 120 carried by a drive shaft 121 that extends through spaced bearing brackets 122 from a motor 123 by which the turntables 111 and 112 are rotated to actuate the knitting operation in relation to the stationary frame structure 108 and cylinders 109 and 110 arranged thereon. These lower and upper platform portions 116 and 117 at which the turntable 111 and 112 are driven carry the warp inlay cam plates 102 and 103 (only the latter of which is shown in FIG. 7), and the feed tubes for the several weft components, as at 105 and 106 in FIG. 7, as well as knitting cams 124 and 125 by which the transfer fingers 100 and 101 are cyclically operated as earlier described, while the remaining upper platform portion 115 of top turntable 111 and lower platform portion 118 of bottom turntable 112 carry the supply package for the weft components as at 126, 127, 128 and 129, together with guide means 130 and 131 for training these components to their respective guide tubes. The warp inlay *w* in turn is supplied from beam packages 132 spaced on support brackets 133 about the frame structure 108, and the fabric F as produced passes between the adjacent edges of cylinders 109 and 110 to be taken down within the bottom one by suitable collecting means (not shown), as in the previously described FIG. 4 embodiment.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

I claim:

1. In the formation of knit fabric simulating a woven structure which involves the steps of feeding spaced warp ends to weft knitting means while laying filling ends at opposite sides of the fed warp, the improvement which comprises causing needle loops of weft knit courses to form wales at the spaces between the warp ends and to execute a shedding motion in relation to said warp in the course of such wale formation so that filling ends are disposed between the needle loops and the warp at both faces of the resulting fabric as it is formed.

2. In weft knitting apparatus for forming knit fabric simulating a woven structure and having means for feeding spaced warp ends to a knitting station while laying filling ends at opposite sides of the fed warp, the improvement which comprises needle means operable at said knitting station between said spaced warp ends to draw knitting yarn into needle loops forming wales thereat, and cam means for causing said needle means to operate in the course of such wale formation so that each drawn needle loop executes a shedding motion in relation to said warp ends sufficient to receive a filling end between the needle loops and the warp at both faces of the resulting fabric as it is knit.

3. In weft knitting apparatus the improvement defined in claim 2 in which the needle means comprises double-hooked needles having a latch at only one end.

4. In weft knitting apparatus the improvement defined in claim 2 in which the needle means comprises double-hooked needles having latches at both ends.

* * * * *